US005215650A

United States Patent [19]

Sapre

[11] Patent Number: 5,215,650

[45] Date of Patent: Jun. 1, 1993

[54] COOLING EXOTHERMIC REGENERATOR WITH ENDOTHERMIC REACTIONS

[75] Inventor: Ajit V. Sapre, West Berlin, N.J.

[73] Assignee: Mobil Oil Corporation, Fairfax, Va.

[21] Appl. No.: 807,004

[22] Filed: Dec. 13, 1991

[51] Int. Cl.[5] ..... C10G 11/18

[52] U.S. Cl. ..... 208/113; 208/160; 585/654; 585/910; 585/911

[58] Field of Search ..... 208/160, 113; 585/910, 585/911, 654; 502/44

[56] References Cited

U.S. PATENT DOCUMENTS

| | | | |
|---|---|---|---|
| 2,735,802 | 2/1956 | Jahnig | 208/160 |
| 4,374,750 | 2/1983 | Vickers et al. | 502/41 |
| 4,739,124 | 4/1988 | Ward | 585/658 |
| 4,840,928 | 6/1989 | Harandi et al. | 502/41 |
| 4,859,308 | 8/1989 | Harandi et al. | 585/910 |
| 4,960,503 | 10/1990 | Haun et al. | 208/160 |
| 5,059,305 | 10/1991 | Sapre | 208/113 |
| 5,062,945 | 11/1991 | Pappal et al. | 208/160 |

*Primary Examiner*—Anthony McFarlane
*Attorney, Agent, or Firm*—Alexander J. McKillop; Malcolm D. Keen; Richard D. Stone

[57] ABSTRACT

Operational flexibility of a fluid catalytic cracking process is improved by indirectly cooling catalyst in an endothermic catalyst cooler. Catalyst withdrawn from the FCC unit is cooled by driving an endothermic chemical reaction, which may be either thermal or catalytic. Dehydrogenation of, e.g., light aliphatics, produced by the cracking reactor in the endothermic cooler allows the FCC unit to adapt to heavier feeds. A preferred endothermic cooler, comprising a base heat exchanger section, transport riser, and solids collection and recycle vessel is disclosed.

13 Claims, 2 Drawing Sheets

COOLING EXOTHERMIC REGENERATOR WITH ENDOTHERMIC REACTIONS

FIELD OF THE INVENTION

This invention relates to fluid catalytic cracking and more particularly to a process and apparatus for cooling the FCC regenerator.

BACKGROUND OF THE INVENTION

The fluid catalytic cracking (FCC) process has become well-established in the petroleum refining industry for converting higher boiling petroleum fractions into lower boiling products, especially gasoline.

In the fluid catalytic process, a finely divided solid cracking catalyst is used to promote the cracking reactions which take place in the feed. The catalyst is used in a very finely divided form, typically with a particle size range of 20–300 microns, with an average of about 60–75 microns, in which it can be handled like a fluid (hence the designation FCC) and in this form it is circulated in a closed cycle between a cracking zone and a separate regeneration zone. In the cracking zone, hot catalyst is brought into contact with the feed so as to effect the desired cracking reactions after which the catalyst is separated from the cracking products which are removed from the cracking reactor to the associated fractionation equipment for separation and further processing. During the cracking reaction, coke is deposited on the catalyst. This deposit of coke masks the active sites and temporarily deactivates the catalyst. Such temporarily deactivated catalyst is commonly called spent catalyst. The catalyst must then be regenerated before it can be reused.

Cracking is an endothermic reaction. Heat for the cracking reaction is usually supplied by the regeneration step. Spent catalyst is oxidatively regenerated to remove the coke. The regeneration takes place in a separate regenerator vessel. Catalyst is maintained in one or more fluidized beds in a regenerator vessel and an oxygen-containing gas, usually air, flows through a distribution grid which mixes air with the spent, coked catalyst. During the regeneration step, the coke is burned and the heat of combustion heats the catalyst. The hot, regenerated catalyst is recycled to the cracking zone to crack fresh, and perhaps recycled feed. Thus, the catalyst circulates continuously between the cracking reactor and the regenerator. The heat for the endothermic cracking reaction is supplied by the exothermic regeneration of the catalyst. Most FCC units, and the moving bed analogue, the Thermofor Catalytic Cracking process, operate in a heat balanced mode, with essentially all of the heat needed for the cracking reaction supplied by the heat released in the catalyst regenerator.

A further description of the catalytic cracking process and the role of regeneration may be found in the monograph, "Fluid Catalytic Cracking With Zeolite Catalysts", Venuto and Habib, Marcel Dekker, N.Y., 1978. Reference is particularly made to pages 16–18, describing the operation of the regenerator and the flue gas circuit.

The FCC process is a mature, but still rapidly changing workhorse in modern refineries. Two areas of concern are the wish to use heavier, cheaper feeds, and the desire to improve the value of some light products. Each area will be briefly reviewed.

Low Value Products

Most FCC products have much greater value than the heavy feed. The lowest value products are the extremely heavy residues from cracking, such as slurry oil, and the light ends. The light alkanes such as propane and ethane which are usually not as valuable as the more reactive alkenes, such as propylene and ethylene. Both thermal and catalytic processes are available to convert light alkanes into light alkenes and hydrogen, but the capital and operating expenses are fairly high, due in large part to the need to heat the light alkanes to the extremely high temperatures needed for efficient dehydrogenation to occur. The limited demand for light alkanes, and the costs of converting them to more valuable chemical intermediates, combine to make light alkanes a low value product.

Heavy Feeds

The FCC process was designed to convert distillable petroleum feeds such as gas oil or vacuum gas oil to lighter products such as gasoline and fuel oil. FCC units are now being pushed to crack even heavier feedstocks, including those containing non-distillable materials, such as resids, which contain relatively large amounts of Conradson Carbon Residues (CCR). Many FCC units have 5 to 10 wt % non-distillable material in the feed. Many process feeds with 1.0 wt % CCR, most of which ends up as coke in the regenerator. The effect of cracking such heavy feeds is to increase the amount of coke that must be burned per unit of feedstock, and make the regenerator run hotter. This is hard on the catalyst (it steams it) and reduces cat:oil ratio in the reactor (reduces conversion). To compensate, refiners have tried to take some heat out the system, either by adding a quench fluid to the riser, or catalyst cooler to the regenerator.

Addition of a quench fluid to the riser can improve conversion of heavy feeds by providing higher temperatures at the base of the riser, then adding a quench fluid such as steam or cycle oil to cool the material in the riser. Heat is removed from the system by vaporizing the quench liquid, and this heat is recovered, or rejected, by condensing the quench liquid downstream of the cracking reactor. It is generally beneficial, but ties up a significant volume in the riser and in downstream processing equipment with vaporized quench fluid. Although this is beneficial, I believed this was not always the best use of the high grade energy in regenerated catalyst. Consider the case of water quenching—a high temperature energy source (regenerated catalyst, with a temperature of 1200°–1500° F., is converted into low pressure steam (at the pressure of the FCC unit) which increases the production of sour water.

FCC regenerators with coolers were common in the early days of FCC, and are now enjoying a resurgence. Such coolers are disclosed in U.S. Pat. Nos. 2,377,935; 2,386,491; 2,662,050; 2,492,948; and 4,374,750, inter alia. These cat coolers remove heat by indirect heat exchange, typically in a shell and tube exchanger. Operating in this way the high grade energy of the catalyst could be converted into high pressure steam, which could be used for power generation, or to heat fractionators or preheat feed to another reactor. This was a better use of the high grade energy in regenerated catalyst, but I believed it was not the best use.

A more productive use of the high grade thermal energy in, and catalytic properties of, FCC catalyst was disclosed in U.S. Pat. No. 4,840,928, which is incorporated herein by reference. Hot catalyst was removed from the regenerator and charged to a separate reactor to contact a light alkane, e.g., propane. This material was dehydrogenated to an olefin and hydrogen, and remove heat from the catalyst, because dehydrogenation is endothermic. Thus heat was removed from the FCC system, and an endothermic reaction, which required high temperatures for maximum conversion, was efficiently conducted. This represented very efficient use of the thermal energy in the FCC catalyst, but required use of FCC catalyst to conduct paraffin dehydrogenation. FCC catalyst is optimized for use in conversion of heavy feeds to lighter products such as gasoline, and not for paraffin dehydrogenation.

I realized that high temperature regenerated catalyst was a valuable source of heat for endothermic reactions requiring extremely high temperatures. I wanted to use this high grade heat, but not directly contact the FCC catalyst with the reactants involved in the endothermic reactions. Using the heat, but not the catalyst, from an FCC regenerator to drive a high temperature endothermic reaction would permit conditions and catalyst to optimized in the endothermic reaction, without contacting the FCC catalyst with the endothermic reactants. In this way, catalyzed high temperature endothermic reactions could be conducted with a catalyst that was incompatible with the FCC unit. Thermal reactions could be driven, without subjecting the FCC catalyst to unnecessary contact with the thermal reactants.

I discovered a way make more efficient use of the high grade energy produced in abundance in modern FCC regenerators.

BRIEF SUMMARY OF THE INVENTION

Accordingly, the present invention provides a fluidized catalytic cracking (FCC) process wherein a heavy hydrocarbon feed comprising hydrocarbons having a boiling point above about 650° F. is catalytically cracked in an FCC unit by direct contact with an inventory of hot regenerated cracking catalyst to lighter products and spent catalyst which is regenerated to produce hot regenerated catalyst, by catalytically cracking said feed in a catalytic cracking reactor means operating at catalytic cracking conditions including direct contact heat exchange of said heavy feed with a source of hot regenerated catalyst to produce a cracking reactor effluent mixture comprising cracked products and spent catalyst containing coke and strippable hydrocarbons; separating said cracking reactor effluent mixture into a cracked product rich vapor phase and a solids rich spent catalyst phase comprising strippable hydrocarbons and coked catalyst; stripping at least a portion of said spent catalyst phase in a catalyst stripping zone with stripping gas to remove strippable compounds and produce stripped coked catalyst; regenerating at least a portion of said stripped coked catalyst in a catalyst regeneration means to produce hot regenerated catalyst which is recycled to said catalytic cracking reactor; characterized by cooling at least a portion of said FCC catalyst inventory by indirect heat exchange against an endothermic chemical reaction in an endothermic cooler having two isolated sections, an FCC catalyst side section and an endothermic cooler reactant side section by: removing at least a portion of said FCC catalyst inventory from said FCC unit and charging same to an inlet of the FCC catalyst side section of the endothermic cooler; charging an endothermically reactive reactant to an inlet of the endothermic cooler reactant side of said heat exchange means; heating said endothermically reactive reactant, by indirect heat exchange with said FCC catalyst, to a temperature sufficient to drive the endothermic reaction and produce endothermic reaction products which are removed via an endothermic cooler outlet as a product and simultaneously remove heat from said FCC catalyst and produce cooled FCC catalyst; removing from an outlet of the FCC catalyst side section of the endothermic cooler said cooled FCC catalyst and charging same back to said FCC unit.

In another embodiment, the present invention provides a fluidized catalytic cracking (FCC) process, wherein a heavy hydrocarbon feed comprising hydrocarbons having a boiling point above about 650° F. is catalytically cracked in an FCC unit by direct contact with an inventory of hot regenerated cracking catalyst to lighter products and spent catalyst which is regenerated to produce hot regenerated catalyst, operating concurrently with an endothermic reaction which is heated by indirect contact with said hot regenerated cracking catalyst, comprising: catalytically cracking said feed in a catalytic cracking reactor means operating at catalytic cracking conditions including direct contact heat exchange of said heavy feed with a source of hot regenerated catalyst to produce a cracking reactor effluent mixture comprising cracked products and spent catalyst containing coke and strippable hydrocarbons; separating said cracking reactor effluent mixture into a cracked product rich vapor phase and a solids rich phase comprising coked catalyst and strippable cracked products; stripping at least a portion of said solids rich phase in a catalyst stripping zone with stripping gas to remove strippable cracked products and produce stripped coked catalyst; regenerating said stripped coked catalyst in a catalyst regeneration means to produce hot regenerated FCC catalyst; removing and cooling at least a portion of said hot regenerated FCC catalyst inventory by heat exchange in an endothermic cooler, and recycling resulting indirectly cooled FCC catalyst to said FCC unit; and heating endothermic reactants in said endothermic cooler, by indirect heat exchange with said removed hot regenerated FCC catalyst, and producing endothermic reaction products which are removed from said endothermic cooler as a product.

In an apparatus embodiment, the invention provides an apparatus for the fluidized catalytic cracking (FCC) of a heavy hydrocarbon feed comprising hydrocarbons having a boiling point above about 650° F. to lighter products comprising a catalytic cracking means having an inlet for said feed, an inlet for a source of hot regenerated FCC catalyst and an outlet for cracked products and spent catalyst produced by the cracking means; a cracked product and spent catalyst separation means connected with said cracking reactor means and adapted to separate a cracked products rich vapor phase from a solids rich spent catalyst phase comprising strippable hydrocarbons and coked FCC catalyst; a catalyst stripping means connected with said separation means adapted to strip at least a portion of said solids rich phase with a stripping gas to remove strippable compounds and produce stripped coked FCC catalyst; a catalyst regeneration means having an inlet for regeneration gas and an inlet for stripped coked FCC catalyst and adapted to regenerate said FCC catalyst to produce hot regenerated catalyst and recycle same to said catalytic cracking reactor means; and an FCC catalyst cooler means comprising an indirect heat exchanger means adapted to maintain two isolated fluidized beds of particulates in a heat exchange relationship on opposite sides of an impermeable partition, said endothermic cooler having an FCC catalyst side and an endothermic cooler reactant side; said FCC catalyst side of said endothermic cooler having an inlet for hot regenerated FCC catalyst connective with said FCC catalyst regenerator and an FCC catalyst outlet for discharge of indirectly cooled FCC catalyst and recycle of same to said FCC regenerator or said FCC reactor; and said endothermic cooler reactant side of said endothermic cooler having an inlet for endothermically reactive reactants and fluidizable solids and outlet for products of said endothermic reaction.

In a preferred apparatus embodiment, the endothermic cooler comprises a vertical disposed vessel having a lower section, a transport riser, and an upper section, said lower section comprising a shell and tube heat exchanger having an FCC catalyst side with an upper FCC catalyst inlet and a lower FCC catalyst outlet, and having an endothermic cooler side with a lower inlet for a supply of fluidizable recycled endothermic cooler catalyst and endothermic cooler reactant feed and an upper outlet for discharge of a mixture of indirectly heated endothermic cooler catalyst, reactants and products into said transport riser; said dilute phase transport riser comprising a vertical conduit contiguous with and mounted above said indirect heat exchange section and having a lower inlet connective with said upper outlet of said endothermic cooler indirect heat exchange section and an upper outlet within said upper section; said upper section comprising an endothermic cooler catalyst/product separation means connective with said transport riser outlet and adapted to separate endothermic cooler catalyst from products of said endothermic reaction and produce an endothermic cooler product phase, which is withdrawn as a product of the process, and an endothermic cooler catalyst phase, and comprising endothermic cooler catalyst recycle means adapted to recycle at least a portion of said endothermic cooler catalyst to said lower section.

DETAILED DESCRIPTION

Figure 1:
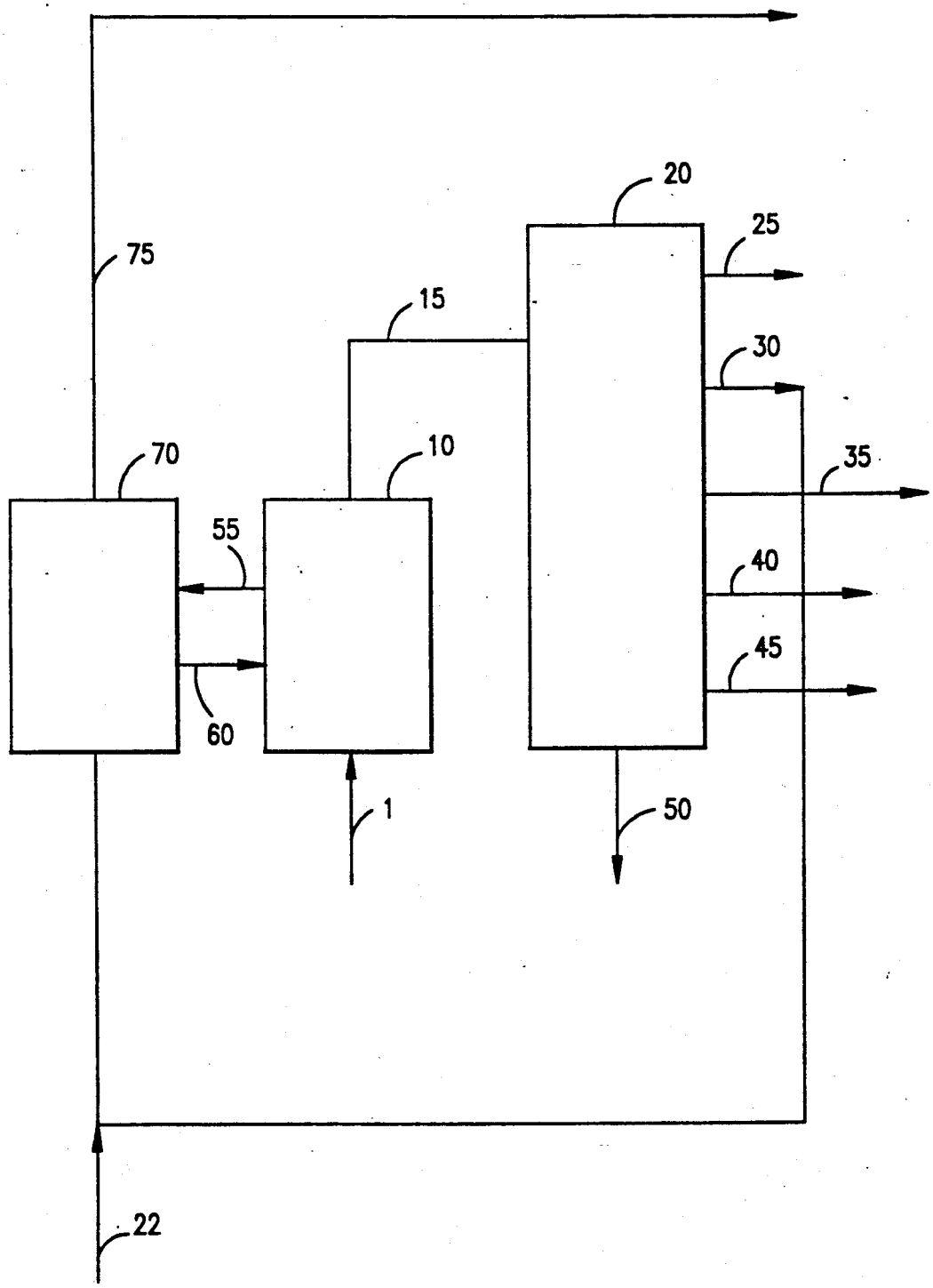
FIG. 1 is a simplified schematic representation of major processing steps in the catalytic cracking process of the present invention.

FIG. 1 schematically shows the major processing units of the invention. A heavy hydrocarbon feed, such as a resid, is charged via line 1 to FCC unit 10. The FCC is simply shown as a box, comprising a reactor and a regenerator. Cracked products are removed via transfer line 15 and charged to main column 20 which produces a fuel gas fraction recovered via line 25, an LPG (Liquified Petroleum Gas) fraction in line 30, a gasoline fraction in line 35, a light distillate fraction in line 40, and a heavy fuel oil fraction in line 45. A bottoms stream, e.g., a slurry oil, may be withdrawn via line 50.

Hot catalyst is withdrawn from FCC unit 10 and circulated via catalyst transfer line 55 to endothermic cooler 70. Cool catalyst is returned via line 60 to the cracking unit. Usually it will be preferred to remove hot regenerated catalyst from the regenerator in FCC unit 10, because this is usually the hottest catalyst. It is possible to withdraw catalyst from any point in the FCC system, e.g., intermediate the stripper and the regenerator.

In the embodiment shown the endothermic reaction is LPG dehydrogenation. LPG from the main column, delivered via line 30, and/or LPG from the refinery saturated gas plant, delivered via line 22, or LPG from a tanker or other source not shown, is charged to endothermic catalyst cooler 70. Endothermic cooler 70 may be a shell and tube heat exchanger or other equivalent means adapted to permit the indirect heat exchange of FCC catalyst with reactants such as LPG. Endothermic cooler 70 may contain a dehydrogenation catalyst, or thermal dehydrogenation of LPG may occur. The LPG dehydrogenation catalyst (if any) and the LPG are physically isolated from the hot FCC catalyst. The products of the endothermic reaction are removed via line 75 and charged to product recovery facilities, not shown.

Figure 2:
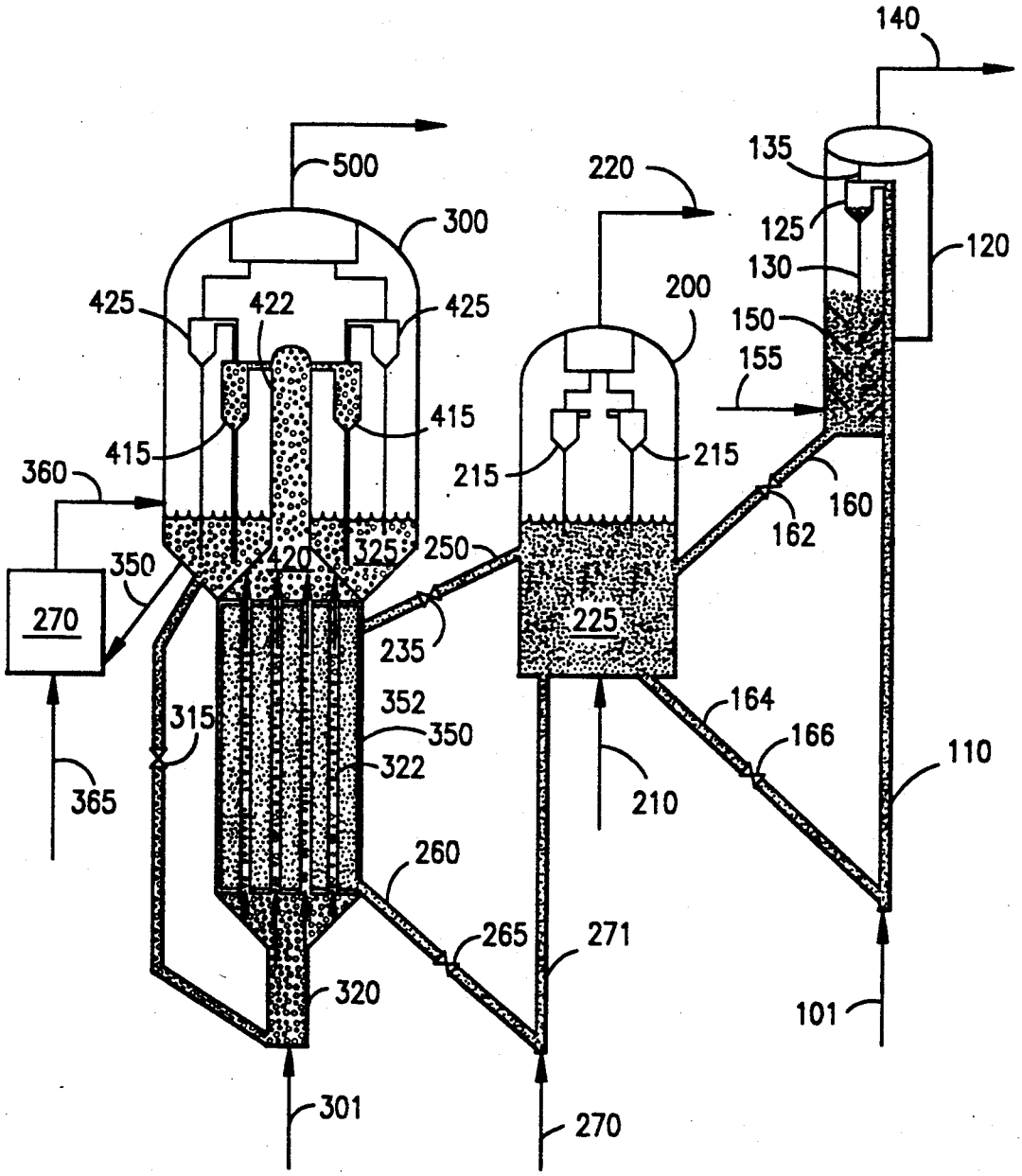
FIG. 2 shows a preferred endothermic catalyst cooler operating in conjunction with a conventional FCC unit.

FIG. 2 shows a preferred apparatus using an endothermic cooler 300 which looks like a high efficiency catalyst regenerator, but is actually a catalyst cooler. The interaction of the cooler with the generally conventional cracking reactor will be explained by reviewing the operation of the cracking reactor, and then of the cooler.

A heavy feed, e.g., a feed with 5 or 10% material boiling above about 1000° F., is charged via line 101 to the base of riser reactor 110. The heavy feed will usually be injected by nozzles not shown, and usually with 2 to 10% atomizing steam, added by means not shown. Heavy feed contacts hot regenerated catalyst added via line 164 and slide valve 166, in the base of the riser. The feed is vaporized and cracked, and a mixture of spent catalyst and cracked products is discharged from the top of riser 110 into cyclone separator 125. Cyclones are preferred for rapid separation of spent catalyst from cracked products, but many FCC units do not use them. In the embodiment shown the cracked vapors are discharged via cyclone vapor outlet 135 into transfer line 140 and sent to the main column, not shown. Spent catalyst is discharged via cyclone dipleg 130 and charged into catalyst stripper 150. Stripping steam, added via line 155, strips some additional cracked products from spent catalyst, and produces stripped catalyst which passes through transfer line 160 and slide valve 162 into regenerator 200. Regenerator 200 is shown as a bubbling bed regenerator, which maintains a dense phase, bubbling fluidized bed of catalyst 225 in a lower portion of the regenerator. Oxygen containing gas, usually air, is added via line 210 to fluidize the catalyst and supply combustion air. Flue gas and entrained catalyst rise up from bed 225 and pass through conventional cyclones 215. Catalyst is returned to the bed via the cyclone diplegs, while flue gas is removed via line 220. Hot regenerated catalyst is withdrawn from bed 225 and recycled via line 164 and slide valve 166 to the base of the cracking reactor to continue the cracking reaction.

The operation just described, of the reactor 110 and regenerator 200 is conventional. In practice many types of reactors, including those with some dense bed cracking, or with multiple reactors, or with quenching, may be used. A variety of stripper designs are used commercially. Many different types of regenerator are used, ranging from high efficiency ones using a fast fluidized bed to the older style bubbling dense bed regenerator 200 shown. What makes the process work is the use of an endothermic reactor 300 in conjunction with a conventional cracking reactor and catalyst regeneration means.

A portion of the hot regenerated catalyst in bed 225 of regenerator 200 is withdrawn via line 250 and slide valve 255 and charged to the hot or shell side of indirect heat exchange region 350 in the base of endothermic cooler 300. Hot regenerated cracking catalyst passes through region 352, which is an FCC catalyst continuous phase surrounding a plurality of heat exchange tubes 322.

LPG is charged via line 301 to meet recycled LPG dehydrogenation catalyst (hereafter "LPG Catalyst") passing though slide valve 315 and line 310 to the base region 320 below the heat exchange region 350. LPG catalyst and LPG pass up through tubes 322 to outlet region 420, which serves both as a manifold to collect converted LPG and LPG catalyst discharged from tubes 322, and as transition section to increase the superficial vapor velocity and promote dilute phase flow into riser 422, where additional conversion of LPG may occur. Conversion products and LPG catalyst are discharged from the riser into primary cyclones 415. Vapors are passed through an additional stage of cyclone separation in cyclones 425 and are removed via transfer line line 500 for further processing. Recovered LPG catalyst is discharged via the cyclone diplegs into LPG catalyst bed 325, and a portion of it recycled via line 310 to meet fresh LPG feed.

It may be beneficial to regenerate some portion of the LPG catalyst, and this may be done by removing some of it via line 350 and charging it to regenerator 370. A regeneration gas, such as air, or other fluid which will regenerate the LPG catalyst, is added via line 365. Flue gas may be removed by means not shown. The regenerated catalyst is returned to the endothermic cooler via line 360.

The reaction conditions in endothermic cooler 300 can be conventional, and will generally be chosen to optimize the endothermic reaction occurring therein. When thermal reactions, such as propane dehydrogenation to propylene, are practiced, the temperatures and residence times of propane will be similar to those used conventionally. When catalytic dehydrogenation is practiced in endothermic cooler 300, time, temperature and dehydrogenation catalyst will be selected to optimize the catalytic dehydrogenation of light alkanes.

The design of endothermic cooler 350 will usually allow somewhat higher conversions per pass to be achieved in both thermal and catalytic endothermic reactions, because of the excellent flow patterns and efficient contacting of reactants with solids. The closed cyclone design shown is very similar to closed cyclones used in FCC riser reactors. Closed cyclones minimize long residence time thermal reactions in, e.g., dehydrogenated products.

The presence of solids significantly enhances heat transfer, so it will usually be beneficial to use a fluidizable catalyst or an inert heat carrier such as sand, alumina or silica. Geldart's group A fluidized particles are preferred to maximize heat transfer. FCC catalyst particles, which are present on the shell side of the heat exchanger, are also Geldart type A particles.

Although the design shown has hot, regenerated FCC catalyst on the shell side and LPG on the tube side the reverse flow is also possible, but not preferred. Thus the hot FCC catalyst could flow down through, or be eluted up, the tubes, with the LPG and LPG catalyst on the shell side.

Now that the invention has been reviewed in connection with the embodiments shown in the Figures, a more detailed discussion of the different parts of the process and apparatus of the present invention follows. Many elements of the present invention can be conventional, such as the cracking catalyst, or are readily available from vendors, so only a limited discussion of such elements is necessary.

FCC FEED

Any conventional FCC feed can be used. The process of the present invention is especially useful for processing stocks which contain large amounts of resid or CCR materials. Feeds which are difficult to process in conventional heat balanced FCC units are ideal for use herein, so for that reason operation with feeds comprising 5 or 10 or more weight percent material boiling above about 1000° F. are preferred. Feeds containing more than 0.5, 1.0 or 2.0 or even more CCR material can be tolerated in the cracking reactor of the present invention because of the endothermic cooler.

Feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles or mixed in with each particle of the cracking catalyst. Additives can be added to enhance octane (shape selective zeolites, i.e., those having a Constraint Index of 1–12, and typified by ZSM-5, and other materials having a similar crystal structure) or additives can remove Ni and V (Mg and Ca oxides).

CO combustion additives are available from most FCC catalyst vendors.

Additives for removal of SOx are available from several catalyst suppliers, such as Davison's "R" or Katalistiks International, Inc.'s "DeSox."

The FCC catalyst composition, per se, forms no part of the present invention.

FCC REACTOR CONDITIONS

Conventional FCC reactor conditions may be used. The reactor may be either a riser cracking unit or dense bed unit or both. Riser cracking is highly preferred. Typical riser cracking reaction conditions include catalyst/oil ratios of 0.5:1 to 15:1 and preferably 3:1 to 8:1, and a catalyst contact time of 0.5–50 seconds, and preferably 1–20 seconds.

It is preferred, but not essential, to use an atomizing feed mixing nozzle in the base of the riser reactor, such as the Maxipass, available from Bete Fog.

It is preferred, but not essential, to have a riser acceleration zone in the base of the riser, as shown in FIGS. 1 and 2.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al.

It is preferred but not essential, to rapidly strip the catalyst, immediately after it exits the riser, and upstream of the conventional catalyst stripper. Stripper cyclones disclosed in U.S. Pat. No. 4,173,527, Schatz and Heffley, may be used.

It is preferred, but not essential, to use a hot catalyst stripper. Hot strippers heat spent catalyst by adding some hot, regenerated catalyst to spent catalyst. A good hot stripper design is shown in U.S. Pat. No. 4,820,404 Owen, which is incorporated herein by reference. A catalyst cooler cools the heated catalyst before it is sent to the catalyst regenerator.

The FCC reactor and stripper per se, can be conventional and form no part of the present invention.

FCC CATALYST REGENERATION

The process and apparatus of the present invention can use many conventional elements most of which are conventional in FCC regenerators.

The present invention can use conventional bubbling dense bed regenerators, as shown in the Figures, but most new units will use a high efficiency regenerator. The essential elements include a coke combustor, a dilute phase transport riser and a second fluidized bed. These elements are well known.

ENDOTHERMIC REACTOR COOLER DESIGN

While the apparatus shown in FIG. 2 represents a highly preferred design, it is not essential. Any conventional endothermic reaction means can be used which is capable of being heated by catalytic cracking catalyst.

Because FCC catalyst can be made to flow like a liquid, many conventional reactor designs based on shell and tube heat exchangers can be used as the endothermic cooler. Hot regenerated catalyst may flow through tubes of a heat exchanger, while a fixed or fluidized bed of catalyst, or an inert heat transfer solid, may be disposed on the shell side to promote an endothermic reaction.

Sufficiently high temperatures can cause endothermic reactions even with no catalyst present, so hot regenerated FCC catalyst may be passed over a tube bundle, through which propane or butane passes. The high temperatures of catalyst regenerators associated with resid crackers easily generate temperatures which promote thermal cracking of light alkanes to alkenes.

Although it is not preferred, it is possible to take many existing catalyst coolers, currently used to make high pressure steam, and convert them into EC's. Because of the possibility of coke formation it will usually be necessary to use very high superficial vapor velocities in the tubes (or shells) to minimize stagnant regions and coke deposition. Relatively short residence times, and somewhat limited conversions, are also beneficial in ensuring that the thermal reactions do not go to equilibrium, which is carbon and hydrogen or methane for hydrocarbons. To minimize dead regions, where coke could form, it will usually be preferably to put the endothermic cooler feed through the tubes, and have the hot regenerated FCC catalyst on the shell side.

When an endothermic cooler such as is shown in FIG. 2 is used, it is possible to select catalysts, feeds, and operating conditions which work well with the FCC unit.

A preferred integration of the endothermic cooler to the FCC involves not only use of the equipment shown in the Figure, but use of the FCC to generate all or a part of the endothermic cooler feed. This concept can be better understood by considering a preferred embodiment, an FCC unit cracking a resid or resid rich feed to eventually produce light aliphatics, and an endothermic cooler using H-ZSM-5 (for paraffin dehydrogenation) or Pt-ZSM-5 (for paraffin conversion to aromatics).

Heavy FCC feeds, especially those with large amounts of asphaltics, will usually deposit large amounts of Ni and V on the catalyst, which will increase yields of contaminant coke and of light paraffinic gas. The additive coke in the feed, e.g., the CCR content of the feed, plus the contaminant coke, will increase the coke yield substantially, and significantly increase regenerator temperature. In the process of the present invention, this increased production of aliphatics, and of heat, can be used to efficiently convert the produced aliphatics into either olefins or aromatics, depending on local markets and the type of catalyst used in the endothermic cooler.

The increase in temperature in the regenerator normally expected from processing such heavy feeds will be largely offset by the corresponding increase in heat removal attributable to the endothermic reaction in the endothermic cooler. Heat removal will allow catalyst circulation to stay the same, or perhaps even increase, allowing "wind-up" of the unit by increasing catalyst circulation and conversion.

When better, cleaner feeds become available, and coke yields drop, the regenerator temperature will drop, so the amount of heat removal in the endothermic cooler needed to maintain heat balance will decrease. Reduced throughput to the endothermic cooler, or preferably increased catalyst circulation or "wind-up" can be used to maintain any desired temperature in the regenerator.

Preferably the pressure in the endothermic cooler is slightly higher than that in the FCC. If this is done, any tube ruptures or slow leaks would cause catalyst to flow from the endothermic cooler into the FCC catalyst inventory. The FCC unit tolerates very well the presence of many types of ZSM-5, preferably H-ZSM-5 rather than Pt-ZSM-5.

Recycle of cooled catalyst from the endothermic cooler directly to the riser reactor, rather than to the regenerator, will make tube ruptures or leaks less hazardous. Any recycled aliphatics, e.g., propane or propylene, from the endothermic cooler will enter the reducing atmosphere of the reactor, rather than the oxidizing atmosphere of the regenerator. Higher pressure in the endothermic cooler will also facilitate further processing of the endothermic cooler effluent in existing equipment, most of which operates at a pressure somewhat lower than the FCC.

endothermic cooler REACTIONS

Any conventional endothermic chemical reactions which proceed at temperatures at or below those of FCC regenerators, e.g., 1000°-1700° F. can be performed in the endothermic cooler. Preferably the endothermic cooler reactions use feedstocks produced by the catalytic cracking operation to facilitate keeping the unit in heat balance. Preferred reactions, catalysts, feedstocks and conditions, are listed below:

LPG dehydrogenation can proceed either thermally or catalytically.

Thermal dehydrogenation involves a pressure of 0.5 psia to 60 psia, preferably 5 psia to 25 psia, and temperatures of 1000°-1700° F., preferably 1200° to 1400° F. Residence times of course vary with temperature, but usually will be within the range of 1 to 300 seconds.

Thermal dehydrogenation will frequently be aided by the presence of a solid to improve heat transfer. Generally, Geldart's group A fluidized particles are preferred to maximize heat transfer. FCC catalyst has a very good particle size distribution, so spent, or fresh, or equilibrium FCC catalyst can be used as the "inert" solid to improve heat transfer. Sand or other equivalent heat transfer material may also be used.

Superficial vapor velocities in the heat transfer tubes should usually be in the range of 0.5 to 15 ft/sec, both to improve heat transfer and to keep the tubes scoured clean.

Catalytic dehydrogenation of LPG involves somewhat milder conditions, i.e., either a lower temperature or shorter residence time or both, depending to a considerable extent on catalyst type and activity. In general catalytic dehydrogenation involves a pressure of 20 psia to 60 psia, preferably 30 psia to 50 psia, and temperatures of 1000°-1700° F., preferably 1050° to 1200° F. Residence times of course vary with temperature, but usually will be within the range of 0.5 to 10 seconds.

Preferred endothermic cooler catalysts are those based on CI 1-12 zeolites, preferably ZSM-5. A highly preferred catalyst is Pt/Sn ZSM-5 or other similar metal containing catalysts.

Endothermic cooler catalyst regeneration is optional, and depends on local conditions. Some catalysts last a long time without regeneration, so periodic replacement or intermittent regeneration may be used to maintain catalyst activity. Continuous regeneration, using an isolated regenerator 270 as shown in FIG. 2 may also be beneficial.

Although propane will be a preferred feedstock in many refineries, the process works well with ethane, butane, light naphtha, heavy naphtha and even heavier stocks. Thermal processing tolerates some heavy stocks, e.g., when a slurry oil feed is charged to an apparatus such as shown in FIG. 2 it is possible to convert slurry oil to carbon black provided that the time and temperature in the endothermic cooler are properly controlled. Carbon black is a premium product, which is somewhat difficult to make, and in many refineries it may be preferably to conduct something like fluid coking in the endothermic cooler, using circulating coke as both a heat transfer medium and a medium on which coke may deposit.

ILLUSTRATIVE EMBODIMENT

The following illustrative embodiment does not represent an actual experiment, but is based on experiments and plant experience and is believed to be a reliable description of what would happen in a commercial plant. The flows will be discussed as if conducted in the FIG. 2 embodiment.

Feed Compositions

Several feeds were considered, representing a more or less conventional FCC feed, with 0.5 wt % CCR, and a heavier feed, with 3.5 wt % CCR. The operation of the unit with the lighter feed will be reviewed first, than the response of the unit to the heavier feed will be shown, to demonstrate how well the endothermic cooler responds to changes in feed composition.

| | VGO FEED (0.5% CCR) | RESID FEED 3.5% CCR |
|---|---|---|
| IBP | 650 | 700 |
| 10% | 700 | 750 |
| 50% | 850 | 925 |
| 90% | 1000 | 1125 |
| Ep | 1050 | 1200 |
| CCR | 0.5 | 3.5 |

The basis of this exercise in an FCC unit processing 20 MBPD of VGO feed in conjunction with a single stage regenerator. The dense bed of the regenerator has an inventory of 150 short tons (136.07 metric tons) of catalyst.

The regenerator dimensions and temperature are as follows: Height 90 ft. (27.43 meters) Diameter 25 ft. (7.62 meters)

The endothermic cooler preferably has a shell 10'-20' in diameter and contains 10,000 to 50,000 tubes, 1.5", 20' tall.

A faujasite FCC catalyst with nickel (>2000 ppm) is regenerated at 1250° F. 10 tons/minute of hot regenerated catalyst is recycled to riser 110 to vaporize and crack the fresh feed. Cracked products are removed via line 140, including 4 MBPD of light, cracked product destined to be recycled to the endothermic cooler 300.

8 tons/minute of hot regenerated catalyst are withdrawn from the regenerator via line 250 and charged to endothermic cooler 300. The hot regenerated catalyst flows through the shell of region 350, heating catalyst and reactants flowing through the tubes.

8 MBPD of LPG are charged via line 301 to mix with 5 tons/minute of endothermic cooler catalyst. 4 MBPD of straight run LPG from the crude unit supplement 4 MBPD of FCC LPG. The mixture of LPG and endothermic cooler catalyst enters the base of the tubes at 1400° F., and leaves the tubes at 1150° F. The endothermic cooler reaction continues in region 420, and in riser 422. The dehydrogenated LPG is recovered via line 500, while recovered endothermic cooler catalyst is recycled via line 310 to contact fresh LPG feed.

When the unit processes a heavier feed, one containing 3.5 wt % CCR, several things happen. The heavier feed, and the greatly increased amount of additive coke, increase the amount of heat released in the regenerator. In a prior art FCC unit, the regenerator temperature would soar, and the amount of catalyst recycled to the riser reactor to maintain a constant top temperature would drop. That does not happen to the same extent in the process of the present invention. The heavier feed will increase the regenerator temperature to some extent, but this temperature riser is moderated by increasing the amount of heat removed in the endothermic cooler.

A heat and weight balance is reported below for both types of feeds, showing how well the FCC+endothermic cooler of the present invention handles heavier feeds.

EXAMPLE 1

LPG CRACKING COOLER

| | FEED A (VGO) | FEED B (RESID) | FEED B + LPG CRACKER COOLER |
|---|---|---|---|
| CCR | 0.5 | 3.5 | 3.5 |
| API° | 21 | 19 | 19 |
| 10% | 650 | 750 | 750 |
| 50% | 850 | 920 | 920 |
| 90% | 1050 | 1100 | 1100 |
| CA | 19.0 | 22.0 | 22.0 |
| Conv. | 73 Vol % | 63 Vol % | 69 Vol % |
| Gasol. | 57 Vol % | 48 Vol % | 54 Vol % |
| LPG | 28 Vol % | 23 Vol % | 23 Vol % |
| Coke | 6.3 Wt % | 6.6 Wt % | 8.4 Wt % |
| Treg | 1240° F. | 1450° F | 1250° F. |
| $C_3$ = | 8.5 Vol % | 5 Vol % | 10 Vol % |
| $C_4$ = | 8.0 Vol % | 5 Vol % | 14 Vol % |
| | | | 70 MMBtu/hr Heat Removed |

Note: yields are reported on an FCC feed basis. To supply the cooling load (70 MMBtu/Hr) LPG to the cooler contains 50% straight run $C_3 + C_4$ from the crude unit. TREG refers to the temperature of regenerated catalyst.

SENSITIVITY WITH THE LPG COOLER FOR DIFFERENT RESIDS

| | FEED B + 70 MMBtu/Hr | FEED B ++ 35 MMBtu/hr | FEED C 70 MMBtu/hr | FEED D 70 MMBtu/hr Cooler Side |
|---|---|---|---|---|
| CCR | 3.5 | 3.5 | 5.5 | 2.5 |
| CA | 22 | 22 | 24.0 | 21.0 |
| Metals (Ni Eq.) | 3000 ppm | | 5000 ppm | |
| Conv. Vol % | 69 | 66 | 64 | 70 |
| Gasol. Vol % | 54 | 55 | 52 | 57 |
| $C_3 = + C_4 =$ Vol % | 23 | 20 | 24 | 22 |
| TREG | 1250 | 1320 | 1375 | 1200 |

Note: Ni Eq. refers to the standard correlation for Ni equivalents, based on the Ni, Fe, V etc. content of the catalyst.
+In this case LPG to the cooler require 50% import from the crude unit straight run to satisfy the heat removed.
++In this case FCC product is sufficient to supply the cooling load.

Feed C is poorer than Feed B, as a result catalyst metals loading (Equilibrium) increases, resulting in higher light ends make. These light ends are cracked to valuable olefins in the cooler.

Discussion

The process of the present invention permits processing of heavier feedstock to the FCC which will deposit more carbon on the FCC catalyst. The additional heat released by burning off the incremental carbon is removed in the endothermic cooler via the endothermic conversion of alkanes to more valuable olefins.

Although it will usually be most efficient to drive the endothermic reaction by indirect heat exchange with hot regenerated catalyst from the regenerator, and to return cooled catalyst from the endothermic cooler to the reactor or to the regenerator, other modes of operation are possible. It may be beneficial to cool FCC catalyst intermediate the reactor outlet and the regenerator, and especially beneficial to cool catalyst intermediate a hot stripper and the regenerator. Although this catalyst will not be as hot as catalyst from the regenerator, it will still be hot enough to drive many endothermic reactions, and will merely require an increase in surface area to compensate for the reduced delta T. What is important is removing heat from the system, not simple removing heat from the regenerator.

It will also be beneficial to place the endothermic cooler within the reactor. This will not be optimum from the point of heat transfer, because this catalyst is not as hot as catalyst in the regenerator, but it may be beneficial from a quenching standpoint, i.e., permitting higher temperatures in the base of a riser reactor, while limiting temperatures at the top using endothermic cooler cooling in an intermediate portion of the riser to remove heat. This mode of operation, with all or a portion of the wet gas produced being charged to the endothermic cooler, will be especially sensitive to operation with feeds with large amounts of CCR. Heavy feeds, leading to high regenerator temperatures, and requiring higher top temperatures to maintain conversion, will produce larger amounts of wet gas. Charging this fraction back to the endothermic cooler will automatically increase riser quench as the feed gets heavier.

The process and apparatus of the present invention allow close coupling of FCC catalyst regeneration with endothermic reactions which require high temperatures for efficient conversion. Coupling of, e.g., catalytic or thermal dehydrogenation of low value products of cat cracking with heat removal from the FCC regenerator, allows the FCC process to achieve much higher conversion and/or throughput than would be possible without the endothermic cooler. An FCC unit with an endothermic cooler can adapt well to heavier feeds, e.g., those containing more than 1.0 wt % CCR, and containing large amounts of metals, because the heavier feeds create more low value products which can be endothermically converted in the cooler, and simultaneously generates more heat to drive the endothermic reaction. Use of FCC catalyst to drive an endothermic reaction allows much use to be made of the high grade energy in the hot FCC catalyst, far better use than merely raising steam. Using an indirectly heated endothermic cooler, it is possible to conduct endothermic reactions at temperatures approaching FCC catalyst temperatures, without exposing the FCC catalyst to contact with the endothermic reactants.

I claim:

1. A fluidized catalytic cracking (FCC) process wherein a heavy hydrocarbon feed comprising hydrocarbons having a boiling point above about 650° F. is catalytically cracked in an FCC unit by direct contact with an inventory of hot regenerated cracking catalyst to lighter products and spent catalyst which is regenerated to produce hot regenerated catalyst, by a. catalytically cracking said feed in a catalytic cracking reactor means operating at catalytic cracking conditions including direct contact heat exchange of said heavy feed with a source of hot regenerated catalyst to produce a cracking reactor effluent mixture comprising cracked products and spent catalyst containing coke and strippable hydrocarbons;

b. separating said cracking reactor effluent mixture into a cracked product rich vapor phase and a solids rich spent catalyst phase comprising strippable hydrocarbons and coked catalyst;

c. stripping at least a portion of said spent catalyst phase in a catalyst stripping zone with stripping gas to remove strippable compounds and produce stripped coked catalyst;

d. regenerating at least a portion of said stripped coked catalyst in a catalyst regeneration means to produce hot regenerated catalyst which is recycled to said catalytic cracking reactor;

said process characterized by cooling at least a portion of said FCC catalyst inventory by indirect heat exchange against an endothermic chemical reaction in an endothermic cooler having two isolated sections, an FCC catalyst side section and an endothermic cooler reactant side section by:

e. removing at least a portion of said FCC catalyst inventory from said FCC unit and charging same to an inlet of the FCC catalyst side section of the endothermic cooler;

f. charging an endothermically reactive reactant selected from the group of ethane, propane, butane, light naphtha, and heavy naphtha to an inlet of the endothermic cooler reactant side of said heat exchange means;

g. heating said endothermically reactive reactant, by indirect heat exchange with said FCC catalyst, to a temperature sufficient to drive the endothermic reaction and produce endothermic reaction products which are removed via an endothermic cooler outlet as a product and simultaneously remove heat from said FCC catalyst and produce cooled FCC catalyst;

2. The process of claim 1 wherein hot regenerated FCC catalyst is charged to said endothermic cooler.

3. The process of claim 1 wherein stripped, coked catalyst is charged to said endothermic cooler.

4. The process of claim 1 wherein said cooled catalyst from said endothermic cooler is charged to said FCC reactor.

5. The process of claim 1 wherein said cooled catalyst from said endothermic cooler is charged to said FCC regenerator.

6. The process of claim 1 wherein at least a portion of said endothermic reactants comprises catalytically cracked products from said cracking reactor.

7. The process of claim 1 wherein said endothermic reactants are selected from the group of ethane, propane, butane, and mixtures thereof.

8. The process of claim 6 wherein said cracked products comprise light aliphatic hydrocarbons including at least one of ethane, propane, butane or mixtures thereof and said catalytically cracked light aliphatics are dehydrogenated in said endothermic cooler.

9. The process of claim 1 wherein said endothermic cooler reaction is thermal dehydrogenation of ethane, propane, butane or mixtures thereof.

10. The process of claim 1 wherein said endothermic cooler reaction is catalytic dehydrogenation of ethane, propane, butane or mixtures thereof.

11. A fluidized catalytic cracking (FCC) process wherein a heavy hydrocarbon feed comprising hydrocarbons having a boiling point above about 650° F. is catalytically cracked in an FCC unit by direct contact with an inventory of hot regenerated cracking catalyst to lighter products and spent catalyst which is regenerated to produce hot regenerated catalyst, by a. catalytically cracking said feed in a catalytic cracking reactor means operating at catalytic cracking conditions including direct contact heat exchange of said heavy feed with a source of hot regenerated catalyst to produce a cracking reactor effluent mixture comprising cracked products and spent catalyst containing coke and strippable hydrocarbons;

b. separating said cracking reactor effluent mixture into a cracked product rich vapor phase and a solids rich spent catalyst phase comprising strippable hydrocarbons and coked catalyst;

c. stripping at least a portion of said spent catalyst phase in a catalyst stripping zone with stripping gas to remove strippable compounds and produce stripped coke catalyst;

d. regenerating at least a portion of said stripped coked catalyst in a catalyst regeneration means to produce hot regenerated catalyst which is recycled to said catalytic cracking reactor;

said process characterized by cooling at least a portion of said FCC catalyst inventory by indirect heat exchange against an endothermic chemical reaction in an endothermic cooler having two isolated sections, an FCC catalyst side section and an endothermic cooler reactant side section by:

e. removing at least a portion of said FCC catalyst inventory from said FCC unit and charging same to an inlet of the FCC catalyst side section of the endothermic cooler;

f. charging an endothermically reactive reactant to an inlet of the endothermic cooler reactant side of said heat exchange means;

g. heating said endothermically reactive reactant, by indirect heat exchange with said FCC catalyst, to a temperature sufficient to drive the endothermic reaction and produce endothermic reaction products which are removed via an endothermic cooler outlet as a product and simultaneously remove heat from said FCC catalyst and produce cooled FCC catalyst;

h. removing from an outlet of the FCC catalyst side section of the endothermic cooler said cooled FCC catalyst and charging same back to said FCC unit and wherein said endothermic cooler comprises:

a lower indirect heat exchange section comprising a shell and tube heat exchange section having on the FCC catalyst side an upper FCC catalyst inlet and a lower FCC catalyst outlet, and having on the endothermic cooler reactant side a lower inlet for a supply of fluidizable recycled endothermic cooler catalyst and endothermic cooler reactant feed and an upper outlet for discharge of a mixture of indirectly heated endothermic cooler catalyst, reactants and products;

a dilute phase transport riser comprising a vertical conduit contiguous with and mounted above said indirect heat exchange section and having an inlet connective with said upper outlet of said indirect heat exchange section and an outlet;

an endothermic cooler catalyst/product separation means connective with said dilute phase transport riser outlet adapted to separate endothermic cooler catalyst from products of said endothermic reaction and produce an endothermic cooler product phase which is withdrawn as a product of the process and an endothermic cooler catalyst phase which is collected as a fluidized bed;

an endothermic cooler catalyst recirculation means having an inlet connective with said fluidized bed of endothermic cooler catalyst and an outlet connective with said lower inlet of said lower indirect heat exchange section.

12. A fluidized catalytic cracking (FCC) process, wherein a heavy hydrocarbon feed comprising hydrocarbons having a boiling point above about 650° F. is catalytically cracked in an FCC unit by direct contact with an inventory of hot regenerated cracking catalyst to lighter products and spent catalyst which is regenerated to produce hot regenerated catalyst, operating concurrently with an endothermic reaction which is heated by indirect contact with said hot regenerated cracking catalyst, comprising:

a. catalytically cracking said feed in a catalytic cracking reactor means operating at catalytic cracking conditions including direct contact heat exchange of said heavy feed with a source of hot regenerated catalyst to produce a cracking reactor effluent mixture comprising cracked products and spent catalyst containing coke and strippable hydrocarbons;

b. separating said cracking reactor effluent mixture into a cracked product rich vapor phase and a solids rich phase comprising coked catalyst and strippable cracked products;

c. stripping at least a portion of said solids rich phase in a catalyst stripping zone with stripping gas to remove strippable cracked products and produce stripped coked catalyst;

d. regenerating said stripped coked catalyst in a catalyst regeneration means to produce hot regenerated FCC catalyst;

e. removing and cooling at least a portion of said hot regenerated FCC catalyst inventory by heat exchange in an endothermic cooler, and recycling resulting indirectly cooled FCC catalyst to said FCC unit; and f. heating endothermic reactants in said endothermic cooler, by indirect heat exchange with said removed hot regenerated FCC catalyst, and producing endothermic reaction products which are removed from said endothermic cooler as a product.

13. The process of claim 12 wherein said endothermic cooler comprises a vertical disposed vessel having a lower section, a transport riser, and an upper section, said lower section comprising a shell and tube heat exchanger having an FCC catalyst side with an upper FCC catalyst inlet and a lower FCC catalyst outlet, and having an endothermic cooler side with a lower inlet for a supply of fluidizable recycled endothermic cooler catalyst and endothermic cooler reactant feed and an upper outlet for discharge of a mixture of indirectly heated endothermic cooler catalyst, reactants and products into said transport riser;

said dilute phase transport riser comprising a vertical conduit contiguous with and mounted above said indirect heat exchange section and having a lower inlet connective with said upper outlet of said endothermic cooler indirect heat exchange section and an upper outlet connective with said;

said upper section comprising an endothermic cooler catalyst/product separation means connective with said transport riser outlet and adapted to separate endothermic cooler catalyst from products of said endothermic reaction and produce an endothermic cooler product phase, which is withdrawn as a product of the process, and an endothermic cooler catalyst phase, and comprising endothermic cooler catalyst recycle means adapted to recycle at least a portion of said endothermic cooler catalyst to said lower section.

* * * * *